US005566939A

United States Patent [19]

Smith, Jr. et al.

[11] Patent Number: 5,566,939

[45] Date of Patent: Oct. 22, 1996

[54] CHEMICALLY REACTIVE RACING GAME

[76] Inventors: Murvel L. Smith, Jr.; W. Todd Howard, both of Rte. 7, Box 880, Amarillo, Tex. 79118

[21] Appl. No.: 617,189

[22] Filed: Mar. 18, 1996

[51] Int. Cl.[6] ..... A63F 9/00

[52] U.S. Cl. ..... 463/58; 273/459; 273/139

[58] Field of Search ..... 273/86 R, 138 R, 273/139, 236, 459

[56] References Cited

U.S. PATENT DOCUMENTS

| | | |
|---|---|---|
| 1,931,995 | 10/1933 | Phillips . |
| 2,116,767 | 5/1938 | Ray . |
| 2,193,282 | 3/1940 | Hansen . |
| 2,603,488 | 7/1952 | Christian . |
| 4,236,714 | 12/1980 | Locke . |
| 4,963,116 | 10/1990 | Huber . |

FOREIGN PATENT DOCUMENTS

| | | | |
|---|---|---|---|
| 227936 | 8/1958 | Australia | 273/86 R |
| 952050 | 11/1949 | France | 273/86 R |
| 435161 | 5/1948 | Italy | 273/86 R |
| 516467 | 1/1953 | Netherlands | 273/86 R |
| 1029649 | 5/1966 | United Kingdom . | |
| 2031739 | 4/1980 | United Kingdom | 273/86 R |
| 2060415 | 5/1981 | United Kingdom . | |

*Primary Examiner*—William E. Stoll
*Attorney, Agent, or Firm*—Richard C. Litman

[57] ABSTRACT

A chemically reactive racing game is provided on a sheet of suitable paper or other material, which sheet is provided with a series of equal length combustible tracks or paths thereon, connected to a single starting point. The paths are formed of a chemical having a relatively low combustibility, thus inhibiting the advance of combustion along the paths to provide a safe action and to prolong the game. The single starting point is provided with another chemical which is more highly combustible, and is capable of ignition solely by frictionally striking an abrasive article there across. The starting point provides sufficient heat to ignite the slow combustion process of the paths, with the player corresponding to the first path to be completely consumed, being the winner. The paths are preferably configured to terminate in a straight finish line which is perpendicular to the portions of the paths immediately adjacent thereto, whether the paths be straight or curved. A kit maybe provided, containing several of the individual racing sheets in a folder, with instructions, warnings, and/or other information, a thermally protective barrier sheet upon which each individual sheet is played, and a frictional striking stick to initiate combustion to start each game.

20 Claims, 3 Drawing Sheets

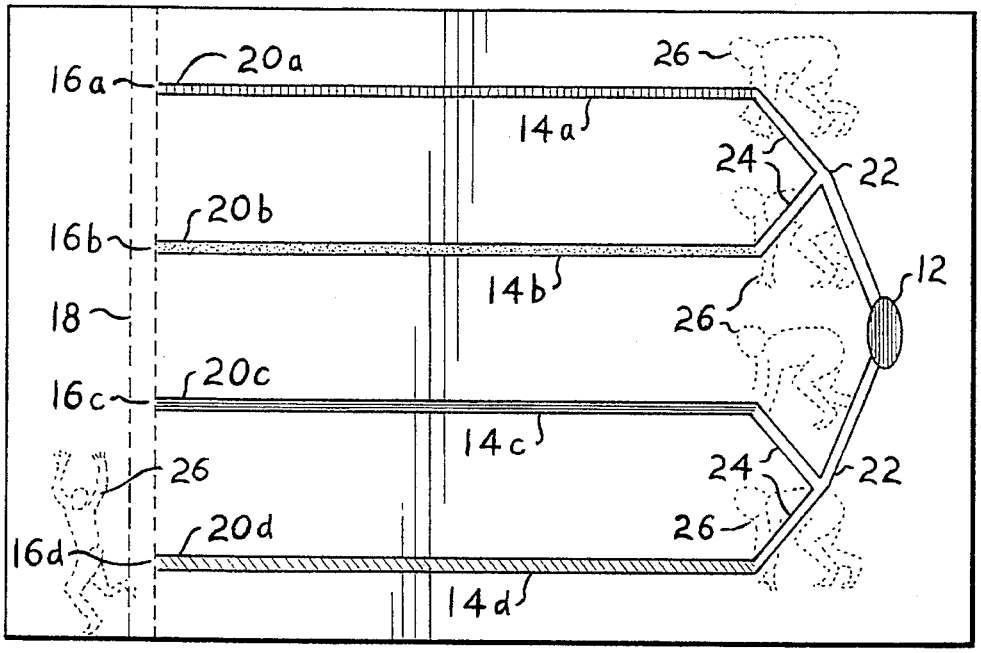
FIG. 2
FIG. 3
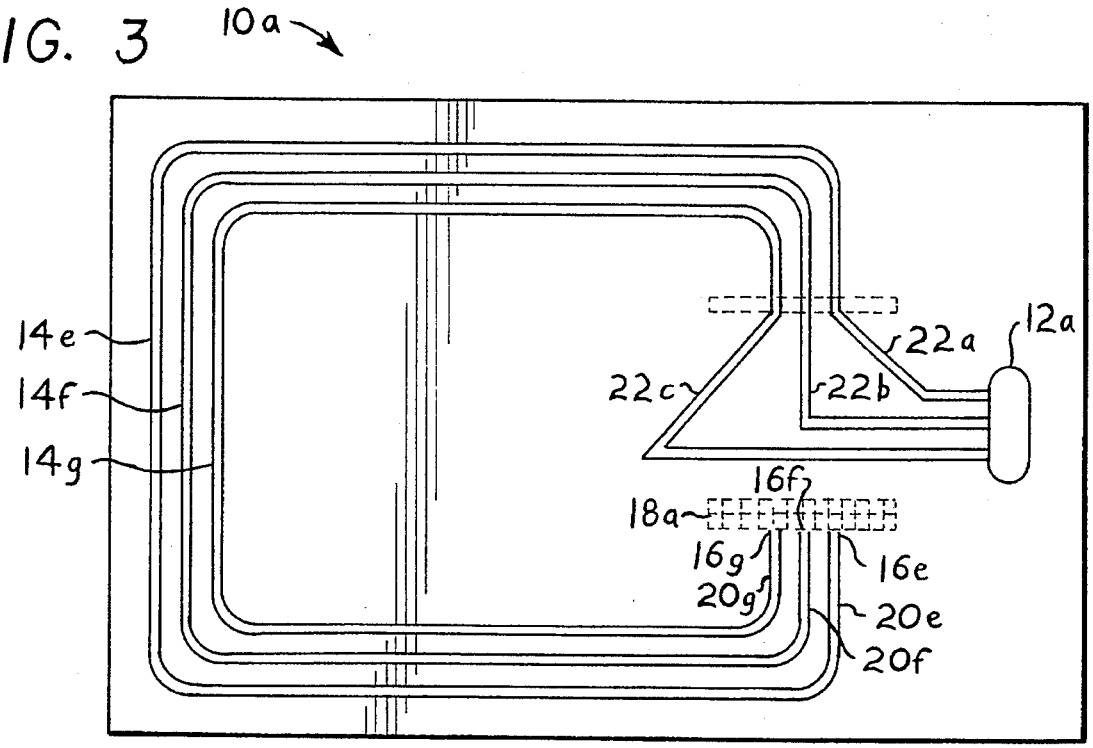

CHEMICALLY REACTIVE RACING GAME

BACKGROUND OF THE INVENTION

1. Field of the Invention

The present invention relates generally to simple games played on paper, and more particularly relates a game wherein a specially treated paper having a single starting point and multiple combustible paths of equal length thereon is ignited, with an inhibited combustion advancing from the starting point along each of the paths to the end point of each path. The winning path is the one first consumed.

2. Description of the Prior Art

People often enjoy minor amusements and diversions during spare moments and leisure time, and accordingly have developed various games and amusements for entertainment. Many of these games are relatively sophisticated and require a board and numerous playing pieces and other articles, and thus are not adaptable to spur of the moment play without prior planning and arrangement.

Accordingly, various simple games played on a sheet of paper have been developed. Most such games (e.g., "battleship") involve a separate sheet of paper for each player, with some common reference being used for orientation between the two. Such games of course cannot be developed as a competitive "race" between players, on a single sheet of paper or the like.

One means of developing such a simple racing game using a single sheet of paper, which game may be played by two or more players, is to provide multiple chemically reactive playing paths on a single sheet of paper or other material, and to initiate a chemical reaction along the paths from a single common starting point. The reaction may be one of rapid oxidation or combustion, preferably inhibited in some way in order to render the game safe and to prolong the action over some period of time. Very few such chemically reactive games have been developed in the past, and those that have been developed, include some limitation or other distinction which render them unlike the present game. A discussion of the prior art of which the inventors are aware, follows below.

U.S. Pat. No. 1,931,995 issued to Jerry M. Phillips on Oct. 24, 1933 describes an Advertising Device comprising a sheet of paper with a practically invisible, flammable message or design printed or formed thereon. Only a single combustible path is provided, thus ruling out any use as a competitive game. Moreover, Phillips states that the combustible path is invisible before ignition. While this may be the case with the chemical mixtures used in the making of the multiple combustible paths of the present game, preferably some distinction is made (color, etc.) so the paths are apparent before combustion. Also, Phillips provides only a single chemical mixture, which must be ignited by a relatively high heat source (match, cigarette, etc.). The present game provides an ignition point of a more highly combustible material at the common beginning of the paths, enabling ignition to be initiated using a frictional striker or the like, so that the present game is relatively safe for play by older children and may be played by non-smokers and players not carrying matches or lighters on their person.

U.S. Pat. No. 2,116,767 issued to Joseph Ray on May 10, 1938 describes a Racing Game having a common starting point connected to a plurality of different tracks or paths of equal length to one another. Ray also discloses only a single chemical mixture used for both the common starting point and the plural tracks, as was the case with the starting point and combustible path of Phillips discussed above. Thus, Ray also requires an ignition source of considerable heat ("cigarette or equivalent," col. 2, line 2). The different chemical mixtures used in the present game allow a much lower ignition point for starting, which then generates sufficient heat for inhibited combustion of the plural paths. Moreover, Ray mentions color only in reference to the addition of chemicals to produce differently colored flames, rather than coloring the paths differently to distinguish them from the ignition point, from the surrounding sheet, and/or from one another. Also, while Ray provides combustible paths of equal length, his layout is such that the end points of the paths are not in alignment with one another, as is typically the case on an actual race track or course. The present invention provides a specially patterned layout for the plural tracks or paths, in order to place the ends of all paths in even alignment with one another.

U.S. Pat. No. 2,193,282 issued to Samuel Hansen on Mar. 12, 1940 describes an Amusement Device closely related to the Phillips device discussed further above, in that only a single chemically combustive path is disclosed. Hansen does provide a frame for the support of the paper, which structure is beyond the scope of the present invention, as the inhibited combustion provided by the specific chemical mixtures of the present game provide safe handling of the paper even during combustion. Hansen provides a "sparking implement" (col. 2, lines 39–40), but provides no information on just how this device operates. As only a single chemical mixture is disclosed along the combustible path, it appears that relatively high heat would be required, which need is obviated by the different chemical mixture of the ignition point of the present game sheets. No coloring or other differentiation of the chemically treated path is made, and in fact Hansen states that his frame provides for some "transparency" of the paper so the path may be more readily seen.

U.S. Pat. No. 2,603,488 issued to John R. Christian on Jul. 15, 1952 describes an Air Actuated Racing Game Apparatus, wherein a plurality of submersible articles may have air injected into them by the players to cause them to rise to the surface. The first to surface wins the game. No relationship is seen to the present chemically reactive game, other than that Christian employs a plurality of parallel tracks or paths in a racing game, with a player corresponding to only a single track being able to win the game.

U.S. Pat. No. 4,236,714 issued to Carl L. Locke on Dec. 2, 1980 describes a Game Apparatus simulating a football field or the like. An insulated cover is provided over an electrically conductive base, with players attempting to maneuver electrically conductive playing pieces over the insulated cover while blindfolded in order to avoid contact with the conductive base, which results in an alarm. No chemically reactive elements or other relationship to the present game is seen.

U.S. Pat. No. 4,963,116 issued to John J. Huber on Oct. 16, 1990 describes a Race Water Track Toy comprising parallel water paths having toy boats for the like therein. Jets of water are provided from a garden hose or the like, to provide movement of the water paths. No chemically reactive means or other relationship to the present game is seen.

British Patent Publication No. 1,029,649 to Hans Biller and published on May 18, 1966 describes a Toy Car-Racing Set comprising a figure eight shaped track having plural paths therein. Each path contains a channel having a spiral spring therein, which is rotated by some means, e.g., electric motor. The advance of the screw-like action of the spring causes miniature cars engaged therewith, to advance around the track. No chemically reactive means or other relationship to the present game is seen, other than the use of cars as moving elements. It will be understood that the present game is not restricted to a simulation of auto racing, or any other specific type of racing.

Finally, British Patent Publication No. 2,060,415 to Tomy Kogyo Co. and published on May 7, 1981 describes a Raceway Game With Remotely Windable Spring Powered Vehicles. The apparatus is at least somewhat similar to that of the Biller publication discussed above, but utilizes spring motors in the individual vehicles for propulsion of the vehicles. The vehicles may be remotely rewound at one point on the track. No chemically reactive means or relationship to the present chemically reactive racing game is seen, other than the use of simulated motor vehicles.

None of the above inventions and patents, taken either singly or in combination, is seen to describe the instant invention as claimed.

SUMMARY OF THE INVENTION

Accordingly, it is a principal object of the invention to provide an improved chemically reactive racing game comprising a sheet of material having a plurality of equal length chemically combustively treated paths thereon, with all of the paths having a common starting point which is treated with a more highly chemically reactive material thereon.

It is another object of the invention to provide an improved chemically reactive racing game in which each of the finishing points of the paths are aligned with one another along a straight finish line which is perpendicular to at least the path segments adjacent to the finish line.

It is a further object of the invention to provide an improved chemically reactive racing game which reaction may be initiated frictionally by striking with an abrasive article, devoid of combustive heat.

An additional object of the invention is to provide an improved chemically reactive racing game which starting point is colored or otherwise marked for ready identification, and which paths may also be colored either similarly or differently, if desired.

Still another object of the invention is to provide an improved chemically reactive racing game which may be provided as a kit, containing a plurality of racing sheets in a folder, instructions and other information for the game, a thermally protective backing sheet, and a striking stick to initiate combustion.

Yet another object of the present invention is to provide an improved chemically reactive racing game and a method of play therefor.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is a top plan view of a single chemically reactive racing sheet of the present game, showing its features.

FIG. 3 is an alternative racing sheet layout, having a plurality of parallel curved racing paths of equal length thereon.

Similar reference characters denote corresponding features consistently throughout the attached drawings.

DETAILED DESCRIPTION OF THE PREFERRED EMBODIMENTS

Figure 1:
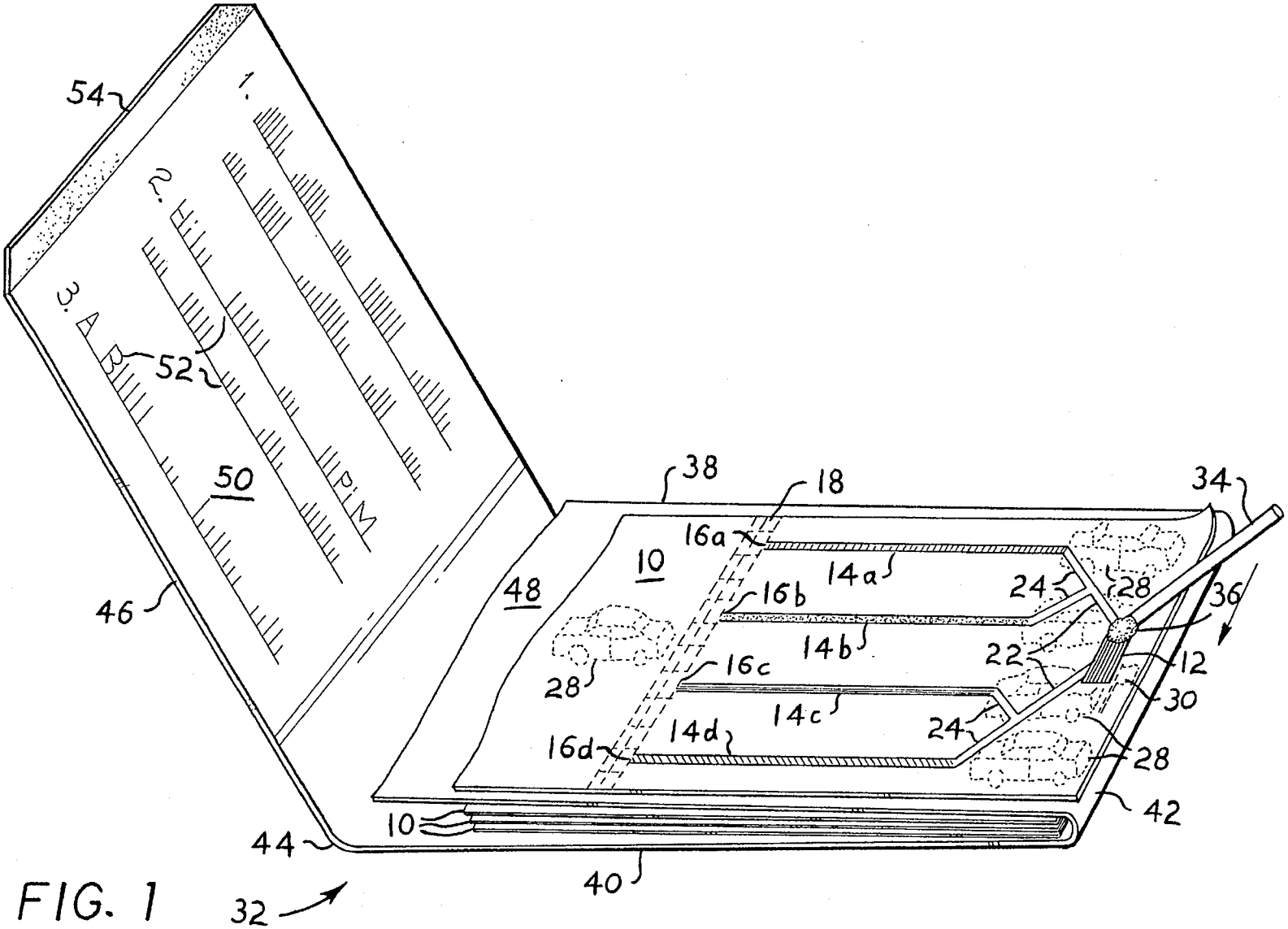
FIG. 1 is a perspective view of one embodiment of the present chemically reactive racing game, showing a kit comprising a folder having a plurality of chemically reactive racing sheets therein, with a single sheet disposed atop a thermally protective barrier and the frictional striker used to start the game.

Referring particularly to FIGS. 1 through 3 of the drawings, the present invention will be seen to comprise a chemically reactive racing game, with the racing sheet 10 of FIG. 2 showing an exemplary layout of such a game. The racing sheet 10 is preferably formed of a thin, flexible sheet of material; parchment paper has been found to work well. The present game may also be provided in the form of a kit, as shown in FIG. 1, with a booklet or folder to hold several such sheets of identical or different configuration, as well as other articles for the play of the present game.

The racing sheet 10 of FIG. 2 includes a single starting point 12, with a plurality of paths 14 (e.g., paths 14*a* through 14*d* of FIG. 2) extending therefrom. The paths 14 are all equal in length, and may be considered as separate, individual tracks, lanes, or the like, as desired. Their only connection is at the single starting point 12 which is common to all of the paths 14, with each of the paths 14*a* through 14*d* terminating at a point 16*a* through 16*d* on a straight finish line 18. The finish line 18 is perpendicular to at least the finish portions 20*a* through 20*d* of the respective paths 14*a* through 14*d* which are immediately adjacent the end points 16*a* through 16*d* of the paths 14*a* through 14*d* at the finish line 18. In this manner, all of the end points 16*a* through 16*d* are even with one another, so the progress and outcome of the game may be easily determined by observers.

Each of the paths 14*a* through 14*d* is connected to the single starting point by a lead line 22, with each segment 24 of the lead line being of equal length to provide for equal travel of the reaction from the starting point 12 to the paths 14*a* through 14*d*. The precise configuration of the lead lines 22 is not important, so long as the total path length from the single common starting point 12 to each of the path end points 16*a* through 16*d*, is equal. With parallel straight paths 14*a* through 14*d*, as shown in FIG. 2, this may be accomplished with branching lead lines 22 as shown, or in some other manner, e.g., bending some of the segments to those lanes or paths 14 which are closer to the starting point 12.

FIG. 3 provides an alternative layout for such a racing sheet, designated as 10*a*. Again, a single common starting point 12*a* is provided, but what might be called the racing portion of each of the paths (designated as 14*e* through 14*g*) is curved. With the curves of the racing portions of the paths 14*e* through 14*g* all being in the same direction, it is apparent that the innermost path 14*g* racing portion will be shorter than the outermost path 14*e* racing portion, unless some compensatory means is provided.

Accordingly, each of the lead lines 22*a* through 22*c*, is of a different length, with the innermost lead line 22*c* being longer than the outermost lead line 22*a*. The difference in lengths of the lead lines 22*a* through 22*c* exactly compensates for the difference in lengths of the racing portions of the paths 14*e* through 14*g*, thus providing precisely equal total path lengths from the starting point 12*a* to the individual end points 16*e* through 16*g*.

As in the finish portions 20*a* through 20*d* of the paths 14*a* through 14*d* of sheet 10, the finish portions 20*e* through 20*g* of the paths 14*e* through 14*g* of sheet 10*a* are straight, with a straight finish line 18*a* disposed perpendicularly thereto across the corresponding end points 16*e* through 16*g* of the paths 14*e* through 14*g*. Thus, a player may observe the advance of the reaction as it closely approaches the finish line 18*a*, with the knowledge that whichever reaction appears to be ahead along a finish portion 20*e* through 20*g* of one of the paths 14*e* through 14*g*, will likely finish first; no confusion is possible as to the leading reaction, with the finish line perpendicular to the finish portions.

The racing sheets of the present game may be configured with virtually any path layout, as desired, so long as the total length of each of the paths on a sheet, from the single starting point to the individual finish or end points, is exactly equal. Any number of two or more lanes, tracks, or paths may be provided on a single sheet, so long as there is no overlap or contact therebetween, and so long as some separation is provided between paths so they are not immediately adjacent one another. The sheets may be marked with representations of competitive entities, as in the runners 26 of FIG. 2, cars 28 of FIG. 1, or other entities not shown, such as horses, boats, aircraft, etc., as desired.

Preferably, the starting point on each of the sheets is indicated in some manner, such as a green flag 30 for the "auto racing" game sheet 10 of FIG. 1. Each of the paths or lanes may also be indicated by different markings or colors, as shown in FIG. 2. It is important that the starting point be colored or otherwise marked in some manner which is distinct from any markings or colors on the remainder of the sheet, in order to provide the user or player with a positive indication of the point at which the chemical reaction of the game is to be initiated on the sheet. As noted above, this may be accomplished by means of a symbolic green flag 30, as shown in FIG. 1, or other colored or marked area, as in the starting points 12 and 12*a* respectively of FIGS. 2 and 3. Other decorative markings may be provided, such as a single runner 26 or car 28 crossing the finish line, etc., as desired.

The present chemically reactive racing game is provided with two different combustible chemicals on each racing sheet. A first relatively highly combustible chemical is provided in a small amount on the starting point of each sheet to initiate the reaction, with a relatively less combustible chemical applied along each of the paths of each sheet to continue the reaction. The first chemical provides a short burst of high heat, somewhat on the order of striking a book match, to provide sufficient heat to ignite the slower burning second chemical. The second chemical is relatively combustibly inhibited, and provides a relatively slow advance of the combustive reaction along each path on the order of one inch per every several seconds or so, somewhat analogous to the slow glowing smolder of a cigarette.

The slower burning second chemical is made in proportions of 224 grams of sodium nitrate (NaNO3), 16 grams of a refined grain product flour, and 16 grams of corn starch, mixed with a half liter (500 grams) of water to form a thin viscous liquid. (Other amounts may be used, so long as the proportions remain the same.) The resulting mixture comprises about 66.1 percent water, 29.7 percent sodium nitrate, and 2.1 percent each of flour (to retard combustion in the dried mixture) and corn starch (to thicken the liquid mixture), by weight. This second mixture is applied to the racing paths of each sheet (e.g., silkscreening, or other method as desired), with the water being allowed to evaporate. The resulting dried second mixture comprises about 87.5 percent sodium nitrate and 6.25 percent each of flour and corn starch, by weight.

The above described second chemical mixture results in a relatively slow, inhibited combustion when dried and ignited, and is not capable of being ignited without open flame, or at least intense heat which is close to the combustion point of the paper to which it is applied. Accordingly, a different first chemical mixture is applied only to the starting point of the sheets, in order to provide easier and more rapid ignition of the starting point and to provide sufficient heat to ignite the second chemical mixture of the paths connected to the starting point.

This first chemical mixture is made in proportions of 75 grams of the hydrated second chemical mixture, three grams of sodium chlorate (NaClO3), and two grams of red phosphorus. This first chemical mixture is a thin viscous liquid comprising about 61.8 percent water, 27.9 percent sodium nitrate, 3.8 percent sodium chlorate, 2.5 percent red phosphorus, and 2 percent each of flour and corn starch. A small amount of this first mixture is then applied only to the starting point of each racing sheet, with the water again being allowed to evaporate. The resulting dried first mixture comprises about 73.1 percent sodium nitrate, 9.8 percent sodium chlorate, 6.6 percent red phosphorus, and 5.25 percent each of flour and corn starch, by weight. The primary combustive ingredients in this first chemical mixture, i.e., sodium nitrate and red phosphorus, are sufficiently flammable that the relatively low heat from a frictionally abrasive article quickly struck or rubbed across the starting point, is sufficient to ignite the first chemical, with the first chemical then igniting the second chemical.

Accordingly, it will be seen that only some form of an abrasive article need be supplied with the chemically reactive racing game kit 32 of FIG. 1. The present kit may include a striking stick 34 having an abrasive striking end 36 thereon, which may be formed by dipping the end in an adhesive and then into sand or other suitable gritty abrasive to coat the adhesive. The striking end 36 may be painted for identification, if desired.

The striking end 36 of the striking stick 34 is then struck or rapidly drawn across the starting position of one of the sheets, with the frictional heat of the strike serving to ignite the first chemical mixture of the starting point. This will be seen to be opposite the action of a conventional match and matchbook, where the abrasive is provided on the book or cover, and the flammable chemical provided on the end of the stick. While the present game may be ignited using an open flame or other sufficiently high heat source, the provision of a relatively highly combustible first chemical allows the present game to be played without need for another flame, thereby providing an additional degree of safety for the players.

Preferably, the kit 32 includes a plurality of racing sheets 10 (and/or 10*a*, as the only difference is the configuration of the paths provided thereon) removably placed within a folder or booklet 38. The booklet or folder 38 may comprise a back cover 40 with a first end 42 and an opposite second end 44, with the first end 42 having a foldable cover 46 extending therefrom and the second end having a thermally protective barrier sheet 48 extending therefrom.

The cover sheet 46 may include some form of attractive advertising logo or indicia on the outer surface thereof (not shown), and on the inner surface 50 various instructions, cautions, and other information 52 may be provided. (Other areas of the folder 32 may contain further information, as desired.) The front cover sheet 46 is adapted to fold over the remainder of the folder 32 for closure, with the distal end 54 of the cover sheet 46 comprising an adhesively coated seal flap which may be wrapped around the opposite second end 42 of the folder or booklet 32 to seal it closed as desired. Other closure means, i. e., slotted tab, etc., may be provided as desired.

The barrier sheet 48 which extends from the second end 42 of the folder 32, is adapted to overlie any stored racing sheets 10/10*a*, etc. sandwiched between the back cover 40 and the barrier 48. A single racing sheet 10/10*a* is placed atop the barrier sheet 48 for play by one of the players, with the thermally protective means (coating, etc.) of the barrier sheet 48 protecting the underlying unused racing sheets from ignition and combustion. Players of the game may select a specific path, e.g., one of the paths 14*a* through 14*d* of the sheet 10 of FIG. 1, as "their" path for that game. The striker stick 34 may then be used by one of the players to frictionally ignite the first chemical at the starting point 12/12*a*, as shown in FIG. 1 and described generally in the first and second steps 56 and 58 of the block diagram of FIG. 4, illustrating the general steps in the method of play of the present game.

Figure 4:
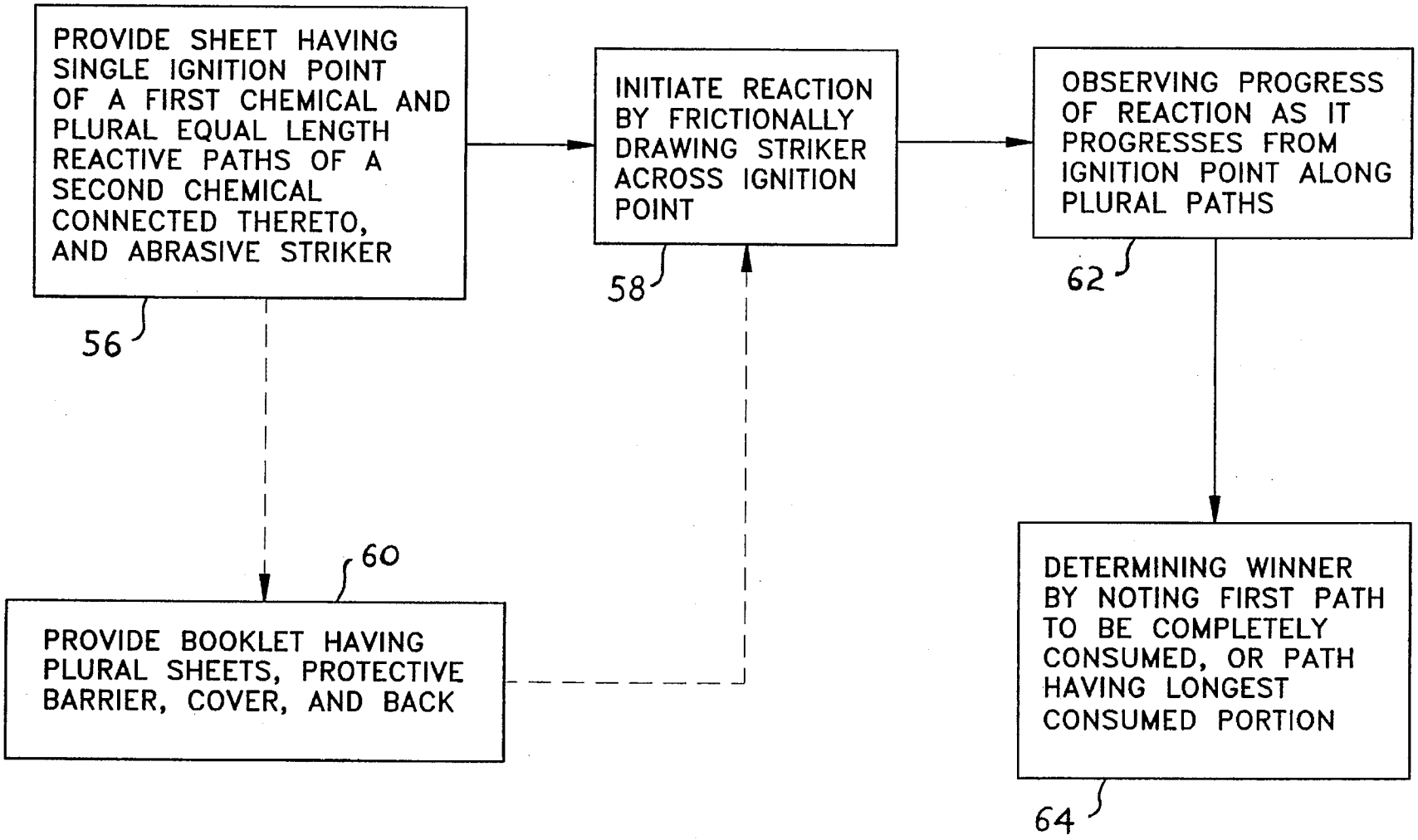
FIG. 4 is a block diagram showing the steps in the method of play of the present game.

It should be noted that the above described method of play includes the provision of the kit 32 illustrated in FIG. 1, and is described as alternative step 60 in FIG. 4. However, the present game may be played with only a single sheet and an abrasive or other heat source for ignition of the starting point if desired, without need for a folder of several sheets and a special striking stick.

The small flare of the starting point first chemical serves to ignite the inhibited slow combustion of the second chemical along the paths of the sheet. The players may then observe the slow progress of the inhibited combustion of second chemical along the paths of the sheet as it progresses, normally taking nearly a minute, or at least a good fraction thereof, to travel the few inches along the second chemical of the paths, as indicated in the third step 62 of FIG. 4.

Eventually, due to minute differences in chemical saturation of the racing sheet, differences in the quality of the paper or other material of the racing sheet, etc., one of the paths will progress slightly faster than the others, and assuming combustion continues to the end of the chemical path at the finish line, will be the first to complete the course. This provides a winner of the game. Alternatively, the relatively slow combustion may not be sustained along one or more of the paths, in which case the path having the longest combusted distance is the winning path, as indicated generally in the fourth step 64 of FIG. 4.

In summary, it will be seen that the above described chemically reactive racing game may provide casual amusement for players of the game. The game may be played virtually anywhere, as the very small amount of chemical providing for frictional ignition is quite safe, and the low flammability of the second chemical provides additional safety. Very little heat is emanated and virtually no open flame, other than a slight glow; the game is at least as safe as a cigarette insofar as fire hazard is concerned.

The materials and chemicals used in the manufacture of the game are relatively inexpensive, thus enabling the game to be provided as a party favor, advertising promotion, etc. Automobile manufacturers and racing teams may find the present game of particular value in promoting their automobiles and/or teams and sponsors thereof, with the folder providing for the display of team colors or the like and the individual racing sheets adapted for marking of representations of specific automobile designs and/or racing team cars. Numerous other uses may be envisioned, limited only by the imagination of the user of the present game.

It is to be understood that the present invention is not limited to the sole embodiments described above, but encompasses any and all embodiments within the scope of the following claims.

We claim:

1. A chemically reactive racing game apparatus, comprising:

a racing sheet formed of a thin sheet of material having a plurality of equal length chemically combustive paths thereon, with each of said paths joined at a single common chemically combustive starting point and each having a separate individual end point;

said chemically combustive starting point having a first combustive chemical thereon having high reactivity and adapted to initiate the chemical combustion of said chemically combustive paths, with said paths having a second combustive chemical thereon having a low reactivity adapted to partially inhibit combustion thereof and to prolong the combustion of said paths, whereby;

said first combustive chemical of said starting point is ignited and the highly reactive combustion thereof ignites said second combustive chemical of said paths joined to said starting point, with said paths being slowly consumed by means of said low reactivity of said second combustive chemical thereon and with the reaction continuing along each of said paths as said paths are consumed.

2. The chemically reactive racing game according to claim 1, wherein:

said first chemical of said starting point is ignited by frictional heating means.

3. The chemically reactive racing game according to claim 1, including:

a striking stick having an abrasive striking end thereon adapted to be struck across said first chemical of said starting point to ignite said first chemical by means of frictional heat.

4. The chemically reactive racing game according to claim 1, wherein:

said second chemical comprises a mix by weight of about 29.7 percent sodium nitrate, 2.1 percent flour, 2.1 percent corn starch, and 66.1 percent water applied to said paths of said racing sheet, with the water being allowed to evaporate to form a dry mixture by weight of about 87.5 percent sodium nitrate, 6.25 percent flour, and 6.25 percent corn starch, and;

said first chemical comprises a mix by weight of about 93.7 percent said second chemical, 3.8 percent sodium chlorate, and 2.5 percent red phosphorus applied to said starting point of said racing sheet, with the water of said second chemical being allowed to evaporate to form a dry mixture by weight of about 73.1 percent sodium nitrate, 9.8 percent sodium chlorate, 6.6 percent red phosphorus, 5.25 percent flour, and 5.25 percent corn starch.

5. The chemically reactive racing game according to claim 1, wherein:

said racing sheet is formed of parchment paper.

6. The chemically reactive racing game according to claim 1, wherein:

each of said paths includes a straight finish portion immediately adjacent each corresponding said end point, with each said end point being located along a straight finish line marked upon said sheet, with said finish line being perpendicularly disposed to each said straight finish portion of said paths.

7. The chemically reactive racing game according to claim 1, wherein:

said starting point and said paths extending therefrom, are marked upon said sheet by color.

8. The chemically reactive racing game according to claim 7, wherein:

said starting point is differently colored than said paths.

9. The chemically reactive racing game according to claim 1, wherein:

said paths each include a racing portion and a lead portion, with at least said racing portion of each of said paths being curved and with said racing portion of at least an innermost one of said paths being shorter than said racing portion of at least an outermost one of said paths, and said lead portion of each of said paths has a length compensating for said shorter and said longer racing portions of said paths to provide said paths of equal length.

10. A kit for a chemically reactive racing game, comprising:

a folder containing a plurality of racing sheets removably placed therein;

each of said racing sheets being formed of a thin sheet of material having a plurality of equal length chemically combustive paths thereon, with each of said paths joined at a single common chemically combustive starting point and each having a separate individual end point;

said chemically combustive starting point of each of said racing sheets having a first combustive chemical thereon having high reactivity and adapted to initiate the chemical combustion of said chemically combustive paths, with said paths having a second combustive chemical thereon having a low reactivity adapted to partially inhibit combustion thereof and to prolong the combustion of said paths, whereby;

one of said racing sheets is dispensed from said folder, said first combustive chemical of said starting point of said one of said racing sheets is ignited and the highly reactive combustion thereof ignites said second combustive chemical of said paths joined to said starting point, with said paths of said one of said racing sheets being slowly consumed by means of said low reactivity of said second combustive chemical thereon and with the reaction continuing along each of said paths of said one of said racing sheets as said paths are consumed.

11. The kit for a chemically reactive racing game according to claim 10, wherein:

said folder includes a first end having a thermally protective barrier sheet extending therefrom and overlying said plurality of racing sheets, with said thermally protective barrier sheet providing for the placement of one of said racing sheets thereon and further providing protection from combustion for any said racing sheets disposed thereunder when said one of said racing sheets placed thereon is ignited.

12. The kit for a chemically reactive racing game according to claim 10, wherein:

at least said folder includes instructions and other information marked thereon.

13. The kit for a chemically reactive racing game according to claim 10, including:

a striking stick having an abrasive striking end thereon adapted to be struck across said first chemical of said starting point of said one of said racing sheets to ignite said first chemical disposed thereon by means of frictional heat.

14. The kit for a chemically reactive racing game according to claim 10, wherein:

said folder includes a plurality of said racing sheets having different path configurations.

15. The kit for a chemically reactive racing game according to claim 10, wherein:

said folder has a first end and a second end opposite thereto, with a cover sheet extending from said second end;

said cover sheet having a distal end with a seal flap extending therefrom, with said seal flap adapted to wrap around said first end of said folder and providing for the sealing closure of said cover sheet about said folder.

16. A method of playing a chemically reactive racing game, comprising the following steps:

(a) providing at least one racing sheet formed of a thin sheet of material having a plurality of equal length chemically combustive paths thereon, with each of the paths joined at a single common chemically combustive starting point and each having a separate individual end point;

(b) providing a first combustive chemical at the chemically combustive starting point having high reactivity and adapted to initiate the chemical combustion of the chemically combustive paths, and providing a second combustive chemical along the paths having a low reactivity adapted to partially inhibit combustion thereof and to prolong the combustion of the paths;

(c) providing a plurality of players corresponding to the number of paths of the racing sheet, with each of the players selecting one of the paths;

(d) initiating a combustive reaction by igniting the first combustive chemical at the starting point;

(e) observing the progress of the inhibited combustive reaction along the plural paths as the reaction progresses therealong, and;

(f) noting the path most consumed by the combustive reaction, with that most consumed path corresponding to the winning player.

17. The method of playing a chemically reactive racing game according to claim 16, including the steps of:

(a) providing a striking stick having an abrasive striking end thereon adapted to be struck across the first chemical of the starting point of the racing sheet, and;

(b) frictionally drawing the abrasive striking end of the striking stick there across and frictionally igniting the first chemical of the starting point by means of frictional heat.

18. The method of playing a chemically reactive racing game according to claim 16, including the step of:

noting the path first completely consumed by the combustive reaction, with that first completely consumed path corresponding to the winning player.

19. The method of playing a chemically reactive racing game according to claim 16, including the step of:

noting the path having the longest completely consumed portion by the combustive reaction, with that longest completely consumed path portion corresponding to the winning player.

20. The method of playing a chemically reactive racing game according to claim 16, including the step of:

providing a kit comprising a folder containing a plurality of racing sheets removably placed therein and a striking stick having an abrasive striking end thereon.

* * * * *